US005626319A

United States Patent [19]

Fusillo

[11] Patent Number: 5,626,319

[45] Date of Patent: May 6, 1997

[54] PAINT BRUSH HOLDER

[75] Inventor: Dennis Fusillo, Tequesta, Fla.

[73] Assignee: Fred and Myrna Cohen as Tenants by the Entireties, North Palm Beach, Fla.

[21] Appl. No.: 576,864

[22] Filed: Dec. 21, 1995

Related U.S. Application Data

[63] Continuation of Ser. No. 260,774, Jun. 16, 1994, abandoned.

[51] Int. Cl.[6] ..... A47B 96/06

[52] U.S. Cl. ..... 248/213.2; 248/110

[58] Field of Search ..... 248/110, 113, 248/213.2, 210; 211/65; 15/146

[56] References Cited

U.S. PATENT DOCUMENTS

| | | | |
|---|---|---|---|
| 2,109,803 | 3/1938 | Prince et al. | 220/701 |
| 2,355,549 | 8/1944 | Myers | 248/110 X |
| 2,463,924 | 3/1949 | Hansen | 211/65 |
| 2,996,215 | 8/1961 | Giza | 220/701 |
| 3,133,668 | 5/1964 | Heise | 220/701 |
| 3,185,311 | 5/1965 | Roberts et al. | 248/213.2 X |
| 4,247,013 | 1/1981 | O'Hori | 220/701 |
| 4,266,686 | 5/1981 | Carter | 211/65 X |
| 5,076,519 | 12/1991 | Panovic | 248/110 |
| 5,253,768 | 10/1993 | Traversa et al. | 248/110 X |

*Primary Examiner*—Ramon O. Ramirez
*Attorney, Agent, or Firm*—McHale & Slavin, P.A.

[57] ABSTRACT

The present invention is an improved paint brush holder constructed from a single piece of plastic which spans the opening of a conventional paint can. On each end of the holder are hooked shaped fingers which secure to the perimeter receptacle of a conventional paint can. A slat which spans the paint can opening provides a surface area available for dragging a paint brush across allowing removal of excess paint. The inclined surface directs the excess paint to flow back into the paint can. The slat further provides a location for holding the paint brush wherein the wet portion of the brush is placed on the slat allowing excess paint to drip back into the container while the brush rests over the side of the can for ease of grasping. A horizontally disposed tab engages the underside of the perimeter receptacle which works in conjunction with the hook shaped ends to prevent movement of the device. The hooked shaped ends deform during lid replacement allowing for sealed storage of the device within the paint container.

3 Claims, 1 Drawing Sheet

PAINT BRUSH HOLDER

This is a Continuation of Ser. No. 08/260,774 filed on Jun. 16,1994, now abandoned

FIELD OF THE INVENTION

This invention relates generally to paint brush holders and more particularly to a device which fits within a conventional paint can available for use in stripping excess paint from a paint brush as well as providing a location for holding of a paint brush.

BACKGROUND INFORMATION

Paint is well known for its protective and decorative properties. Modern paint consists of several chemical compounds including a fluid vehicle, such as linseed oil, that solidifies when exposed to air. For this reason, paint is stored in a sealed container and applied by spreading thinly across a surface. Once exposed to air the paint "dries" thereby permanently adhering to the surface.

To apply paint it is recommended that paint removed from the sealed container is immediately spread across a surface. However, situations exist where paint cannot be applied quickly enough to prevent the solidification process. For this reason it is preferable that paint remains in its original container and an applicator is used to remove only as much paint as needed. The most efficient storage container for paint is the original container. A typical container for storing paint is a universally accepted metal can having an open top that is sealed with a lid. The lid is made of stamped metal having a V-shaped lip capable of engaging a perimeter receptacle located along the open top of the paint can. The lid and perimeter receptacle each allow sufficient deformation so as to form an air tight seal.

The common method of removing paint from a paint can is by removal of the lid and dipping an applicator, such as a paint brush, into the paint can. To prevent dripping paint from the applicator, excess paint is removed by dragging the brush portion of the applicator against the inner edge of the paint can. Ideally the excess paint will flow back into the paint can. Realistically the excess paint fills the perimeter receptacle and the paint drips down the outside surface of the can.

Paint that drips down the side of the can is wasted and should the paint drip to the floor it is difficult to clean. Further, if the paint can is to be used as the storage container the excess paint should be removed from the perimeter receptacle or the sealing will cause the excess paint to splatter.

If the applicator needs to be set down to move a ladder, mask a window, or the like, a clean spot is needed to prevent the applicator from being contaminated with dirt. Attempting to balance the applicator on the edge of the can be disastrous for if the applicator falls into the paint, the handle will be covered with paint. If the applicator falls over the edge of the can, the applicator may fall on an unclean surface require cleaning or the area that it falls on may require cleaning. Should a clean area be provided, it must be maintained in a clean state or cleaned before and after each use.

Thus, what is needed in the art is a device capable of removing excess paint from a paint brush and provides a continuously clean location for setting of the paint brush when not in use.

SUMMARY OF THE INVENTION

The present invention is an improved paint brush holder which satisfies the aforementioned needs. Constructed from a single piece of plastic, the device spans the opening of a conventional paint can providing a large surface area for use in removal of excess paint from a paint brush. The surface area of the device which spans the paint can opening is inclined to direct the excess paint back into the container. The device is secured to the paint can along the perimeter receptacle taking advantage of an inherent feature in conventional paint cans. The ends of the device include hook shaped fingers which are slidably inserted in the perimeter receptacle so as not to interfere with lid closure thus allowing the device to remain in the paint can during storage. A horizontally disposed tab is positioned at each end for placement beneath the perimeter receptacle to secure the device into position.

To place into operation, the lid of a paint can is removed wherein the device is inserted by placement of each end of the device into the receptacle formed along the perimeter of the paint can while the horizontal tabs are placed beneath the receptacle perimeter. The hooked shaped ends conform to a perimeter section of the paint can to maintain the device in a predetermined position as depicted by the curvature of the paint can. Upon placement the device is positioned slightly offset the center of the paint can with the inclined surface spanning across the opening of the paint can. To use the device a paint brush is first dipped into the paint and then dragged across an upper edge of the inclined section which strips the excess paint from the brush. The inclined surface allows the excess paint to flow back into the paint can. Should the paint brush need to be set down, the holding device allows the wet portion of the brush to rest over the paint while the handle portion of the brush is allowed to rest over the side of the can. Thus, paint will drip into the can while the handle remains free of paint and readily available to grasp.

Unique to the instant device is its ability to remain within the confines of the paint can for storage. Replacement of the paint can lid provides both storage of the paint as well as maintaining the paint brush holder in a clean environment. The hook shaped ends of the device do not interfere with sealing of the paint can and once the lid is removed, the device is again available for use. Alternatively, the device can be removed from its securement to the perimeter receptacle for use in another paint can.

Accordingly, a primary objective of the instant invention is to provide a paint holding device that resides within a conventional paint can for the purpose of removing excess paint from a paint brush and directing said excess paint from spilling over the edge or filling the perimeter receptacle of a conventional paint can.

Still another objective of the instant invention is to provide a paint holding device that can be stored in a conventional paint can without interfering with sealing.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

DETAILED DESCRIPTION

Although the invention has been described in terms a specific embodiment, it will be readily apparent to those skilled in this art that various modifications, rearrangements and substitutions can be made without departing from the spirit of the invention. The scope of the invention is defined by the claims appended hereto.

Figure 1:
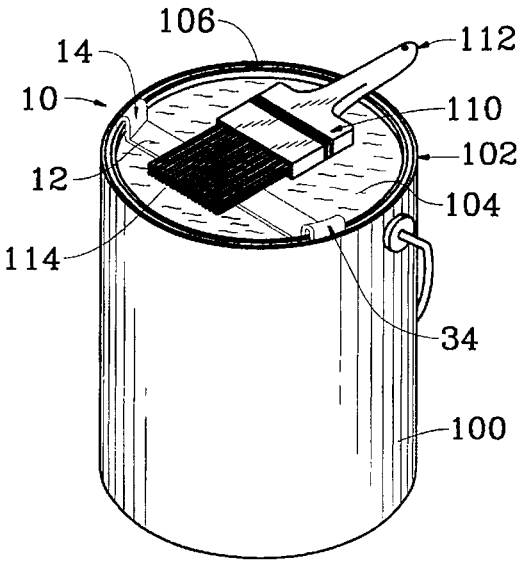
FIG. 1 is a pictorial view of the instant invention placed within a paint can for use as a paint brush holder.
Figure 2:
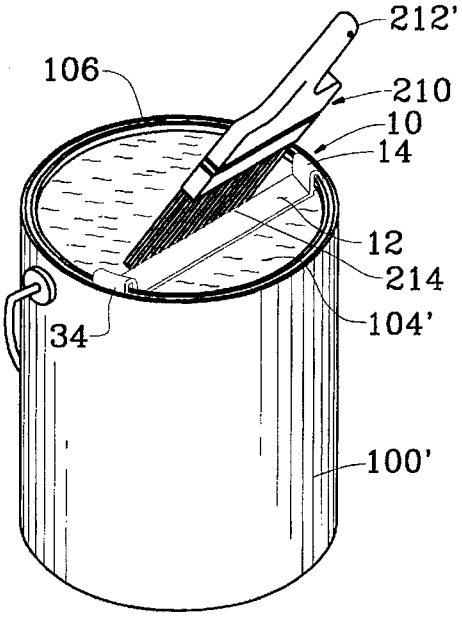
FIG. 2 is a pictorial view of the instant invention placed within a paint can for use in removing excess paint from a paint brush.

FIG. 1 is a pictorial view of the paint brush holder of the instant invention which forms a ledge 10 for placement within a conventional paint can container 100. In this illustration, a paint brush 110 is shown laying on a cross-over portion of the device 10 which forms a slat 12. The handle 112 of the brush 110 extends over the edge 102 of the paint can 100 making it readily available and free of paint. When the paint brush 110 is placed in this position, any excess paint 104 that is found on the applicator end 114 of the brush is allowed to drip back into the container 100. The ends 16 and 34 hook into a perimeter receptacle 106 formed along the edge of all conventional paint cans. FIG. 2 sets forth another pictorial view of the paint brush holder 10 placed within the paint can container 100'. In this illustration a paint brush 210 is shown as the applicator portion 214 is being wiped across the slat 12 of the paint brush holder 10. Thus, when in use the device 10 provides a means for removal of excess paint 104' from the applicator portion of the brush and allowed to drip back into the container 200. The side walls of the fingers 14 and 34 maintain the brush in the center of the device while being used further preventing paint from entering into the perimeter receptacle 106.

Figure 3:
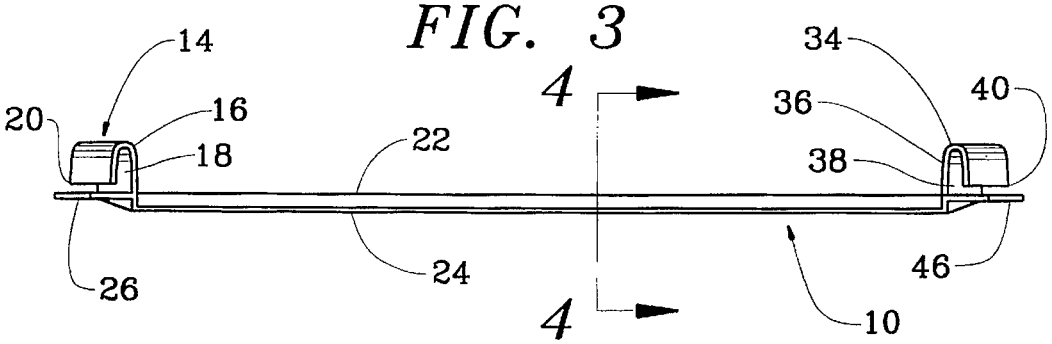
FIG. 3 is a side view of the invention.
Figure 4:
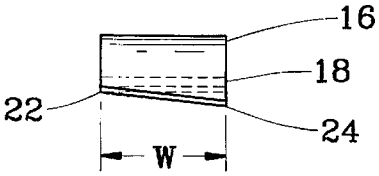
FIG. 4 is a cross section view taken along lines 4–4 of FIG. 3.
Figure 5:
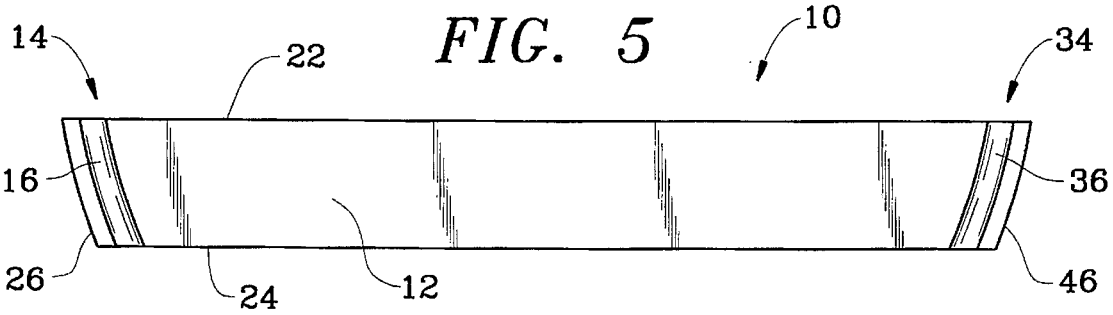
FIG. 5 is a top view of FIG. 3.

As described later in greater detail, the slat 12 is inclined to allow paint to quickly flow back into the container. This lessens the amount of time the paint is exposed to air while in a thinned state. As shown in FIGS. 1 and 2, the device 10 is offset from the center of the can allowing the paint brush to be easily inserted into the paint can during use. The actual hardness of the material used for construction of the device has a direct relation to the width $^{w}$ of the device. Hard plastic or metal construction allows sufficient rigidity for a smaller width while a softer material requires a larger width. Soft plastics are acceptable as long a the finger portion is deformable so as to allowing closure of the container by allowing replacement of the paint lid. FIGS. 3–5 depict the device 10 which is preferably manufactured from a single piece of plastic. It should be noted that the device can also be manufactured from metal and fully integrated into the manufacture of the container. The device resembles a ledge 10 having a centrally disposed slat 12 supported at a first end by finger 14 which extends upward and perpendicular from the horizontal placement of the slat 12. The finger 14 is formed from a deformable hook 16 resembling an inverted U-shape. The U-shape is set inwardly a sufficient distance allowing the outwardly facing surface 18 of the hook 16 to engage the inner surface of the perimeter receptacle 106 wherein the end 20 actually inserts into the perimeter receptacle 106 of the paint can 100. The width $_{w}$ of finger 14 conforms to a portion of the circular shape of the perimeter receptacle 106. The slat 12 utilizes an inclined upper surface wherein the width $^{w}$ is defined by first side edge 22 and second side edge 24. The first side edge 22 is positioned at a higher elevation than second side edge 24 providing disparate horizontal planes so that excess paint will drain from the slat 12 by gravity. At the bottom of the finger 14 is a locking tab 26 which extends outwardly from surface 18 along a lower edge of the finger 16 for engaging the underside of the perimeter receptacle 106. The locking tab 26 prevents the device 10 from lifting out of the receptacle 106 should the brush be dragged to heavily across the slat 12.

A second finger 34 forms a mirror image of the first finger 34 by supporting the opposite end of the slat 12. The finger 34 is formed from a deformable hook 36 resembling an inverted U-shape and is also placed upward and perpendicular from the horizontally placed slat 12. The U-shape is set inwardly a sufficient distance allowing the outwardly facing surface 38 of the hook 36 to engage the inner surface of the perimeter receptacle 106 wherein end 40 is insertable into the opposite side of the perimeter receptacle 106 from the insertion of finger 14. The width $^{w}$ of finger 34 conforms to a portion of the circular shape of the perimeter receptacle 106. Locking tab 46 extends outwardly from surface 38 along a lower edge of the finger 36 for engaging the underside of the perimeter receptacle 106. The locking tab 46 prevents the device 10 from lifting out of the receptacle 106 should the brush be dragged to heavily across the slat 12.

The device is shown installed on a one gallon pail but it should be noted that variations for use with ¼, ½ or even five gallon sized cans is deemed within the scope of this invention. Once installed, the fingers 14 and 34 are designed to be deformed upon replacement of a paint lid allowing for proper sealing of the container.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim is:

1. A paint brush holding device comprising:

a one piece support structure defined by a first inverted U-shaped end element constructed from resilient deformable material, said end element having a distal end and a proximal end, said distal end operatively associated with and insertable into a perimeter receptacle of a paint can;

a first locking tab justapositioned to said proximal end of said first end element and extending outwardly therefrom below said distal end, said first locking tab positionable beneath said paint can perimeter receptacle;

a second end element spaced apart from said first end element forming a mirror image thereof, said second end element insertable into the perimeter receptacle of said paint can at a position diametrically opposed to the positioning of said first end element;

a second locking tab extending outwardly from said second end element forming a mirror image of said first locking tab, said second locking tab positionable beneath said paint can perimeter receptacle; an inclined slat support member of nominal thickness formed integral to and maintaining said first and second end elements in a spaced apart relationship, said slat support member having an upper surface and a lower surface;

wherein said support structure is positionable over paint material stored in a paint can upon removal of a paint can lid from a perimeter receptacle whereby placement of said distal ends of said end members into said perimeter receptacle and positioning of said locking tabs beneath said perimeter receptacle providing a rigid support for a paint brush over the paint material, said deformable material of said end elements allowing replacement of said paint can lid while said end members are secured in said perimeter receptacle.

2. The paint brush support according to claim 1 wherein said support is constructed from plastic.

3. The paint brush support according to claim 1 wherein a length of each said end element extends along a portion of the perimeter receptacle to maintain said holder at a predetermined fixed centrally disposed position allowing access to contents stored in said can from either side of said support.

* * * * *